US008113904B1

(12) United States Patent
Walterscheid

(10) Patent No.: US 8,113,904 B1
(45) Date of Patent: Feb. 14, 2012

(54) FLYING TOY HAVING BOOMERANG FLIGHT CHARACTERISTICS AND CONTROLLED LANDING ABILITIES

(76) Inventor: Steve Walterscheid, Bend, OR (US)

( * ) Notice: Subject to any disclaimer, the term of this patent is extended or adjusted under 35 U.S.C. 154(b) by 183 days.

(21) Appl. No.: 12/708,369

(22) Filed: Feb. 18, 2010

(51) Int. Cl.
*A63H 27/00* (2006.01)

(52) U.S. Cl. ..... 446/36; 446/61

(58) Field of Classification Search ..... 446/31, 446/33, 34, 36, 46, 61, 66; 473/514
See application file for complete search history.

(56) References Cited

U.S. PATENT DOCUMENTS 2,885,206 A * 5/1959 Ensley ..... 472/9
3,036,832 A * 5/1962 Ellman et al. ..... 473/514
3,403,910 A 10/1968 Claycomb
4,222,573 A 9/1980 Adler
4,421,320 A * 12/1983 Robson ..... 473/589
4,708,682 A 11/1987 Schentrup
4,772,030 A * 9/1988 Hunt ..... 473/590

* cited by examiner

*Primary Examiner* — Nini Legesse
(74) *Attorney, Agent, or Firm* — LaMorte & Associates, P.C.

(57) ABSTRACT

A flying toy assembly having a secondary body suspended from a boomerang rotor configuration. The rotor configuration includes a plurality of rotor blades that radially extend from a common hub area. The central hub area has a top surface, a bottom surface, and a predetermined thickness between the top surface and the bottom surface. An annular grommet extends through the central hub area. The grommet defines a hole having a length generally equal to the thickness of the central hub area. A secondary body is attached to the grommet. A shaft extends from the secondary body. The shaft extends through the hole in the grommet, thereby joining the secondary body to the rotor configuration. Stops are provided on the shaft. The stops are disposed a predetermined distance apart along the shaft. The predetermined distance is at least twice as long as the length of the hole in the grommet.

18 Claims, 3 Drawing Sheets

FLYING TOY HAVING BOOMERANG FLIGHT CHARACTERISTICS AND CONTROLLED LANDING ABILITIES

BACKGROUND OF THE INVENTION

1. Field of the Invention

In general, the present invention relates to toy helicopters. More particularly, the present invention relates to toy helicopters having rotors that are manually thrown as a boomerang.

2. Prior Art Description

Boomerangs have been used by the aboriginal peoples of Australia for thousands of years.

Boomerangs were originally developed as hunting tools. However, due to the looped flight pattern exhibited by a boomerang, boomerangs have significant play value and have therefore been commercialized as toys.

Originally, hunting boomerangs were carved out of wood and were intentionally made heavy so they would cause injury upon impact. Boomerangs designed as toys are made much smaller and lighter than hunting boomerangs. Furthermore, toy boomerangs are often made of soft plastic or foam to ensure that the boomerangs do not cause injury upon impact.

The original wooden boomerangs are generally V-shaped, having two intersecting wings. It has been discovered that when such a boomerang configuration is made of lightweight plastic or foam, the boomerang no longer flies in the looped path characteristic of a traditional boomerang.

In order to make a lightweight boomerang fly in a manner characteristic of a traditional wooden boomerang, the number of wings radially extending from the boomerang must be increased to three, four, or five. Furthermore, the wings must by symmetrically disposed about a common center point. By providing each wing with a shape of an airfoil, the toy boomerang will fly following a looped path. Such prior art toy boomerangs are exemplified by U.S. Pat. No. 3,403,910 to Claycomb, entitled Toy Boomerang, and U.S. Pat. No. 4,222,573 to Adler, entitled Boomerang.

In an attempt to increase the play value of a toy boomerang, toy manufacturers experimented with adding secondary objects to the toy boomerang. For example, helicopter bodies were connected to the bottom of the toy boomerang so that the toy boomerang would look like a helicopter in flight. Such prior art patents are exemplified by U.S. Pat. No. 4,708,682 to Schentrup, entitled Helicopter Toy.

A problem associated with connecting a secondary object to a toy boomerang is that the weight and the aerodynamic drag caused by the presence of the secondary object tends to hold the spinning wings of the toy boomerang into a single plane during flight. This causes the toy boomerang to fly in a straight line rather than to fly in the looped flight path characteristic of a traditional boomerang. Furthermore, since the mass of the rotors is greater than the mass of the secondary object, the toy is top heavy in flight. Consequently, such toys have a propensity to crash land or land upside down at the end of a throw.

A need therefore exists for a toy construction having a boomerang that can be joined to a secondary object, such as a helicopter body, wherein the presence of the secondary object does not inhibit the toy from flying in a looped path or inhibit the toy from landing upright. This need is met by the present invention as described and claimed below.

SUMMARY OF THE INVENTION

The present invention is a flying toy assembly having a secondary body suspended from a boomerang rotor configuration. The rotor configuration includes a plurality of rotor blades that radially extend from a common hub area in a symmetrical pattern. The central hub area of the rotor configuration has a top surface, a bottom surface, and a predetermined thickness between said top surface and said bottom surface. An annular grommet extends through the central hub area. The grommet defines a hole having a length generally equal to the thickness of the central hub area.

A secondary body is attached to the grommet. A shaft extends from the secondary body. The shaft extends through the hole in the grommet, thereby joining the secondary body to the rotor configuration.

Stops are provided on the shaft. The stops are disposed a predetermined distance apart along the shaft. The predetermined distance is at least twice as long as the length of the hole in the grommet. Accordingly, when the shaft passes through the grommet, the rotor configuration is free to rotate about the shaft and reciprocally move along the shaft between the stops. The ability of the rotor configuration to move reciprocally along the shaft as it spins helps the flying toy assembly fly in a looped path and land upright.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention flying toy assembly can be embodied in many ways, such as a flying bird, the embodiment illustrated shows the toy configured as a helicopter. This embodiment is selected in order to set forth the best mode contemplated for the invention. The illustrated embodiment, however, is merely exemplary and should not be considered a limitation when interpreting the scope of the appended claims.

Figure 1:
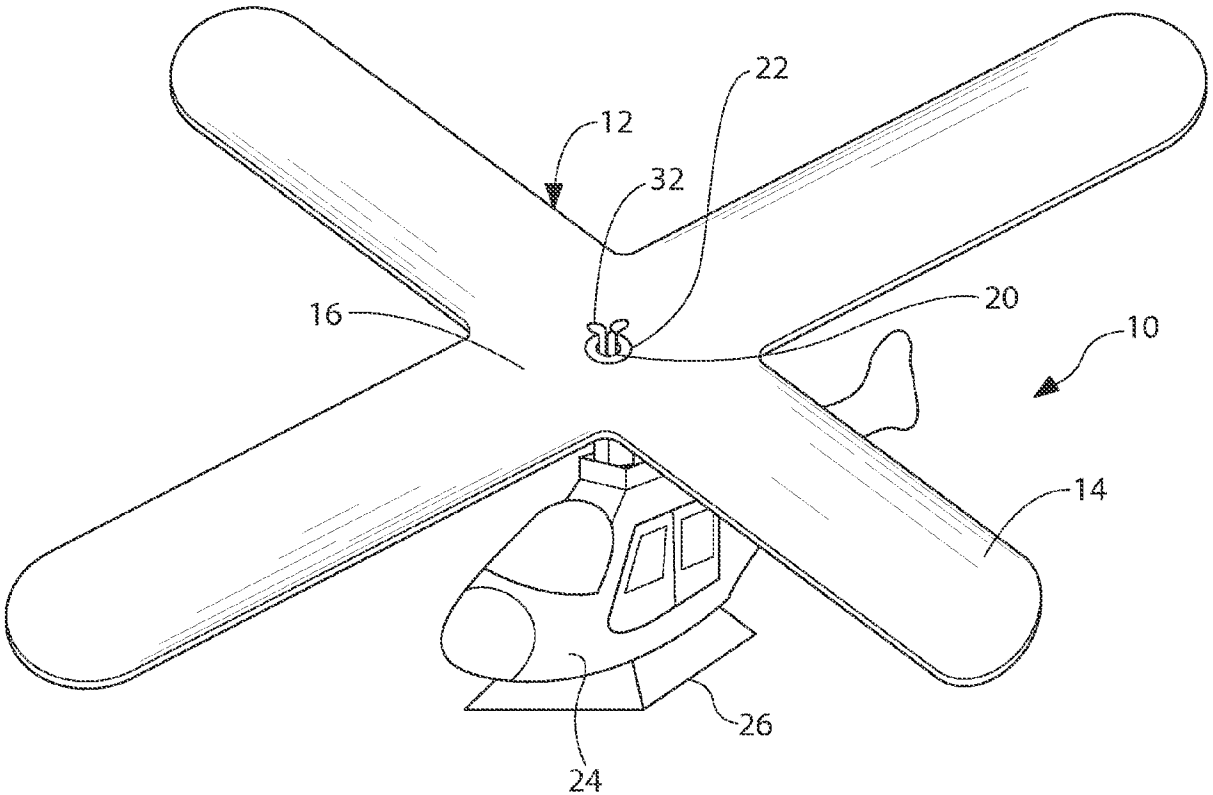
FIG. 1 is a perspective view of an exemplary embodiment of a flying toy assembly.
Figure 2:
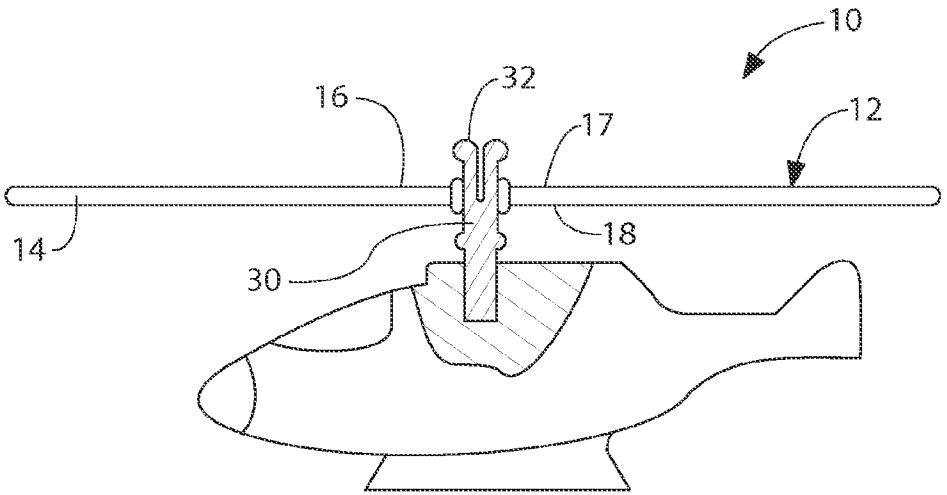
FIG. 2 is a partially cross-sectioned side view of the exemplary embodiment of FIG. 1.
Figure 3:
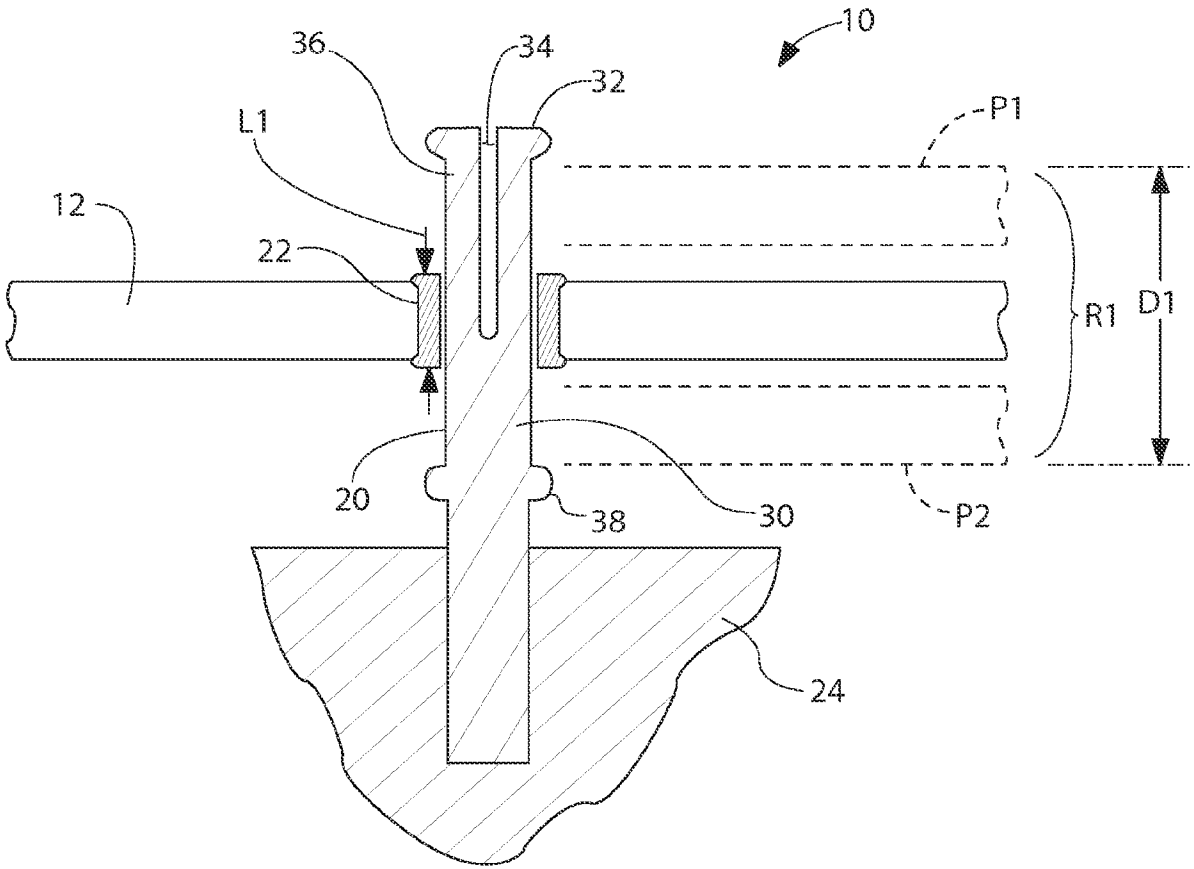
FIG. 3 is an enlarged cross-sectional fragmented view of the portion of the flying toy assembly containing a shaft.

Referring to FIG. 1 in conjunction with FIG. 2 and FIG. 3, there is shown an exemplary embodiment of the present invention flying toy assembly 10 that is shaped as a toy helicopter. The flying toy assembly 10 includes a molded configuration of plastic rotors. The rotor configuration 12 includes at least three rotor blades 14 symmetrically extending from a common central hub area 16. In the shown embodiment, four rotor blades 14 are present. However, any plurality of rotor blades 14 greater than three can be used. Each of the rotor blades 14 in the rotor configuration 12 is identical in shape and embodies the cross-sectional shape of an airfoil. The rotor configuration 12 would be considered a toy boomerang if not assembled into the flying toy assembly 10 of the present invention.

A hole 20 is formed in the geometric center of the rotor configuration 12. Depending upon the type of plastic or foam used to mold the rotor configuration 12, the hole can be formed straight through the hub area 16 or through a grommet 22 mounted in the hub area 16. In the exemplary embodiment, a grommet 22 is shown.

The central hub area 16 of the rotor configuration 12 has a top surface 17 and a bottom surface 18. The grommet 22 extends through the hub area 16 from the top surface 17 to the bottom surface 18. The hole 20 has a predetermined length L1 that is equal to the thickness of the hub area 16 containing the hole 20.

A secondary body in the form of a fuselage body 24 is suspended from the blade rotor configuration 12. In the shown embodiment, the fuselage body 24 is shaped as the body of a helicopter. However, it will be understood that other shapes can be used. For instance the fuselage body 24 can have the shape of a bird, a plane, or a flying superhero. Regardless of its configuration, the fuselage body 24 is preferably lightweight and soft, being molded from lightweight foam or being hollow with a thin plastic shell. A flat landing base 26 or set of landing gear is provided at the bottom of the fuselage body 24. The landing base 26 enables the fuselage body 24 and the entire flying toy assembly 10 to rest upright on a flat horizontal surface.

A shaft 30 extends upwardly from the fuselage body 24. The shaft 30 is permanently affixed to the fuselage body 24. Accordingly, the shaft 30 cannot rotate independently. The shaft 30 has a top end 32 that is forked. That is, a slot 34 is formed down the center of the shaft 30, creating two flexible prongs 36. Lateral stops 38 are formed at the top end of each of the flexible prongs 36, for a reason that will be later explained.

A bottom stop 40 is formed on the exterior of the shaft 30 a predetermined distance D1 below the top end 32 of the shaft 30. The shaft 30 has an outside diameter that is greater than the inside diameter of the hole 20 in the grommet 22. Furthermore, both the lateral stops 38 and the bottom stop 40 have an outside diameter that is greater than the inside diameter of the hole 20 in the grommet 22. The predetermined distance D1 between the bottom stop 40 and the lateral stops 38 is preferably between one centimeter and four centimeters. The preferred length L1 of the hole 20 in the grommet 22 is preferably between 2 millimeters and 8 millimeters. In ratio, it is preferred that the distance D1 between the stop and the top end 32 of the shaft 30 is between two and four times as great as the length L1 of the hole 20.

Referring to FIG. 3, it can be seen that the grommet 22 of the rotor configuration 12 passes over the top end 32 of the shaft 30. This is done by pressing the two flexible prongs 36 together until the lateral stops 38 come together in an area small enough to pass through the grommet 22. Once the grommet 22 passes over the top end 32 of the shaft 30, the flexible prongs 36 expand back to their original positions. This causes the grommet 22 and its surrounding rotor configuration 12 to become entrapped between the bottom stop 40 and the lateral stops 38 at the top end 32 of the shaft 30.

The inside diameter of the hole 20 in the grommet 22 is greater than the outside diameter of the shaft 30. Accordingly, the rotor configuration 12 rotates freely about the shaft 30. Furthermore, the rotor configuration 12 is free to reciprocally move up and down the length of the shaft 30 in the range R1 between the bottom stop 40 and the lateral stops 38. As such, the rotor configuration 12 is free to move to a top position P1 where the rotor configuration 12 abuts against the lateral stops 38 and a bottom position P2, where the rotor configuration 12 abuts against the bottom stop 40.

When the rotor configuration 12 moves between the top position P1 and the bottom position P2, the center of gravity for the entire flying toy assembly 10 changes. This ability to change the center of gravity supplies the flying toy assembly 10 with the ability to both fly in a looped path and land upright.

Referring back to all figures, it will be understood that in order to utilize the flying toy assembly 10, a person grasps one of the rotor blades 14 extending from the rotor configuration 12. The flying toy assembly 10 is then thrown in a manner where spin is applied to the rotor configuration 12. The flying toy assembly 10 subsequently takes flight with the rotor configuration 12 spinning. The spinning of the rotor configuration 12 causes the various rotor blades 14 to provide lift during flight. The degree of lift depends upon the force of the throw, the rate of spin and the pitch formed in the rotor blades 14. As the flying toy assembly 10 flies, different forces are applied to both the rotor configuration 12 and the fuselage body 24 suspended from the rotor configuration 12. If those forces move the rotor configuration 12 away from the fuselage body 24, the rotor configuration 12 moves up the shaft to the top position P1. Conversely, if forces move the rotor configuration 12 toward the fuselage body 24, the rotor configuration 12 moves to its bottom position P2. Both types of forces are commonly experienced during flight.

As the position of the rotor configuration 12 changes, the center of gravity for the entire flying toy assembly 10 changes. The changes in the center of gravity help to alter the flight path of the flying toy assembly 10 and cause the flying toy assembly 10 to fly in a looped path, characteristic of a traditional boomerang.

As the rotational speed of the rotor configuration 12 decreases, the lift provided by the rotor configuration 12 decreases. At some point the lift of the rotor configuration 12 becomes secondary to gravity. The weight of the fuselage body 24 under the rotor configuration 12 moves to the bottom of the flying toy assembly 10. As the flying toy assembly 10 descends to the ground, the landing base 26 on the bottom of the fuselage body 24 typically touches the ground first. Once in contact with the ground, gravity causes the rotor configuration 12 to fall along the shaft 30 to its bottom position P2. This lowers the center of gravity for the flying toy assembly 10 and makes the flying toy assembly 10 more stable. The result is that the flying toy assembly 10 stays upright on its landing base 26, even as the rotor configuration 12 slows to a stop and the flying toy assembly 10 experiences any resonance forces exerted by imbalances in the slowing spinning rotor configuration 12. Accordingly, the ability of the rotor configuration 12 to slide significantly along the shaft 30 enhances the ability of the flying toy assembly 10 to both fly in a looped path and consistently land upright.

It will be understood that the embodiment of the present invention that is illustrated and described is merely exemplary and that a person skilled in the art can make many variations to that embodiment. For instance, the number of rotors, the shape of the rotors, and the shape of the fuselage body can all be altered to the design choice of a manufacturer. All such embodiments are intended to be included within the scope of the present invention as defined by the claims.

What is claimed is:

1. A flying toy assembly, comprising:

a rotor configuration having a plurality of rotor blades that radially extend from a common hub area in a symmetrical pattern, said hub area having a top surface, a bottom surface and a predetermined thickness between said top surface and said bottom surface;

a hole extending though said hub area;

a secondary body;

a shaft extending from said secondary body, wherein said shaft extends through said hole in said hub area of said rotor configuration, thereby joining said secondary body to said rotor configuration; and stops disposed a predetermined distance apart along said shaft, said predetermined distance being at least twice as large as said predetermined thickness of said rotor configuration, wherein said rotor configuration is free to rotate about said shaft and reciprocally move along said shaft between said stops.

2. The assembly according to claim 1, further including a grommet lining said hole.

3. The assembly according to claim 1, wherein said secondary body is configured as an aircraft fuselage.

4. The assembly according to claim 1, wherein said rotor configuration is made of foam plastic.

5. The assembly according to claim 1, wherein said predetermined distance between said stops is greater than two times said thickness of said common hub area.

6. The assembly according to claim 1, wherein said rotor configuration is both selectively attachable to and detachable from said shaft.

7. The assembly according to claim 1, further including a landing base coupled to said secondary body for supporting said flying toy assembly in an upright position on a flat surface.

8. A toy helicopter assembly, comprising:

a plurality of rotor blades that radially extend from a common hub area, said hub area having a top surface, a bottom surface and a hole extending through said hub area, wherein said hole extends a predetermined length from said top surface to said bottom surface;

a helicopter body;

a shaft extending from said helicopter body, wherein said shaft extends through said hole in said hub area, thereby interconnecting said helicopter body to said plurality of rotor blades; and stops disposed a predetermined distance apart along said shaft, said predetermined distance being at least twice as long as said hole, wherein said hub area is free to rotate about said shaft and reciprocally move along said shaft between said stops.

9. The assembly according to claim 8, further including a grommet, wherein said hole is formed through said grommet.

10. The assembly according to claim 8, wherein said plurality of rotor blades is unistructurally fabricated from a single piece of foam plastic.

11. The assembly according to claim 8, wherein said predetermined distance between said stops is greater than two times said length of said hole.

12. The assembly according to claim 8, wherein said rotor configuration is both selectively attachable to and detachable from said shaft.

13. The assembly according to claim 8, further including a landing base under said helicopter body for supporting said toy helicopter assembly in an upright position on a flat surface.

14. A flying toy assembly, comprising:

a boomerang having at least three rotor blades;

an annular grommet affixed to said boomerang, wherein said grommet defines a hole of a predetermined length;

a secondary body;

a shaft extending from said secondary body through said hole in said grommet, thereby joining said secondary body to said boomerang; and stops disposed a predetermined distance apart along said shaft, said predetermined distance being at least twice as large as said predetermined length of said hole, wherein said boomerang is free to rotate about said shaft and reciprocally move along said shaft between said stops.

15. The assembly according to claim 14, wherein said boomerang is fabricated from a single piece of foam plastic.

16. The assembly according to claim 14, wherein said predetermined distance between said stops is greater than two times said length of said hole.

17. The assembly according to claim 14, wherein said boomerang is both selectively attachable to and detachable from said shaft.

18. The assembly according to claim 14, further including a landing base under said secondary body for supporting said flying toy assembly in an upright position on a flat surface.

* * * * *